US009051095B2

(12) United States Patent
Antal, Sr.

(10) Patent No.: US 9,051,095 B2
(45) Date of Patent: Jun. 9, 2015

(54) SEALING OVERCAP FOR A CONTAINER

(71) Applicant: Sonoco Development, Inc., Hartsville, SC (US)
(72) Inventor: Keith E. Antal, Sr., Valatie, NY (US)
(73) Assignee: Sonoco Development, Inc., Hartsville, SC (US)

( * ) Notice: Subject to any disclaimer, the term of this patent is extended or adjusted under 35 U.S.C. 154(b) by 0 days.
(21) Appl. No.: 14/349,366
(22) PCT Filed: Oct. 8, 2012
(86) PCT No.: PCT/US2012/059180
§ 371 (c)(1),
(2) Date: Apr. 3, 2014
(87) PCT Pub. No.: WO2013/055613
PCT Pub. Date: Apr. 18, 2013
(65) Prior Publication Data
US 2014/0238988 A1 Aug. 28, 2014
Related U.S. Application Data
(60) Provisional application No. 61/546,377, filed on Oct. 12, 2011.
(51) Int. Cl.
*B65D 53/00* (2006.01)
*B65D 51/18* (2006.01)
(Continued)
(52) U.S. Cl.
CPC ..... *B65D 53/00* (2013.01); *B65D 43/0212* (2013.01); *B65D 51/18* (2013.01);
(Continued)
(58) Field of Classification Search
CPC ..... B65D 51/1616; B65D 51/1661; B65D 51/1688; B65D 2539/003
USPC ..... 220/233, 256.1, 305, 785, 787, 789, 220/790, 802, 366.1
See application file for complete search history.

(56) References Cited

U.S. PATENT DOCUMENTS 2,752,059 A 11/1950 Schneider
2,859,786 A 2/1956 Tupper
(Continued)

FOREIGN PATENT DOCUMENTS

EP 0248744 A1 12/1987
EP 1197439 A2 4/2002
EP 1236653 A1 9/2002

OTHER PUBLICATIONS

International Search Report and Written Opinion for PCT/US2012/059180, (Date of Search Jan. 16, 2013).

*Primary Examiner* — Fenn Mathew
*Assistant Examiner* — Andrew T Kirsch
(74) *Attorney, Agent, or Firm* — Flaster/Greenberg P.C.

(57) ABSTRACT

An overcap is provided for use in sealing a container of the type having an outer rim, an inside wall surface, and an inner rim spaced inwardly from the inside wall surface, with the inner rim forming a container opening. A flexing portion is formed within the body portion of the overcap and is moveable between a first sealing position and a second sealing position. The flexing portion includes a downwardly depending wall member positioned adjacent the inside wall surface of the container in the first sealing position. A sealing plug is provided and is moveable between the first sealing position and the second sealing position. The sealing plug includes a peripheral surface dimension for frictional engagement with the inner rim, releasably closing of the opening in the second sealing position. The sealing plug is separated from the inner rim in the first sealing position.

30 Claims, 6 Drawing Sheets

(51) Int. Cl.

| | |
|---|---|
| ***B65D 51/12*** | (2006.01) |
| ***B65D 41/18*** | (2006.01) |
| ***B65D 51/16*** | (2006.01) |
| ***B65D 39/00*** | (2006.01) |
| ***B65D 43/02*** | (2006.01) |

(52) U.S. Cl.

CPC . *B65D2251/0018* (2013.01); *B65D 2251/0093* (2013.01); *B65D 2543/00092* (2013.01); *B65D 2543/00296* (2013.01); *B65D 2543/0037* (2013.01); *B65D 2543/00435* (2013.01); *B65D 2543/00527* (2013.01); *B65D 2543/00537* (2013.01); *B65D 2543/00564* (2013.01); *B65D 2543/00638* (2013.01); *B65D 2543/00685* (2013.01); *B65D 2543/0074* (2013.01); *B65D 2543/00796* (2013.01)

(56) References Cited

U.S. PATENT DOCUMENTS

| | | | | |
|---|---|---|---|---|
| 3,001,658 | A | | 3/1960 | Herter |
| 3,061,139 | A | | 10/1962 | Edwards |
| 3,107,022 | A | | 10/1963 | Wandell |
| 3,142,409 | A | | 7/1964 | Ross |
| 3,203,571 | A | | 8/1965 | Plunkett |
| 3,232,470 | A | | 2/1966 | Gibson |
| 3,380,610 | A | | 4/1968 | Krieps |
| 3,381,872 | A | | 5/1968 | Holder et al. |
| 3,424,340 | A | * | 1/1969 | Rocher ..... 220/320 |
| 3,428,208 | A | | 2/1969 | Kosar |
| 3,484,016 | A | | 12/1969 | Turner |
| 3,559,843 | A | | 2/1971 | Kern |
| 3,568,871 | A | | 3/1971 | Livingstone |
| 3,613,938 | A | | 10/1971 | Westcott |
| 3,747,792 | A | | 7/1973 | Anthony |
| 3,773,207 | A | | 11/1973 | Dokoupil et al. |
| 3,815,771 | A | | 6/1974 | Marks |
| 4,027,776 | A | | 6/1977 | Douglas |
| 4,413,748 | A | | 11/1983 | Kessler et al. |
| 4,574,966 | A | | 3/1986 | Sandhaus |
| 4,771,905 | A | | 9/1988 | Perne et al. |
| 5,147,059 | A | * | 9/1992 | Olsen et al. ..... 220/281 |
| 5,251,770 | A | | 10/1993 | Bartley et al. |
| 5,791,473 | A | | 8/1998 | Decker et al. |
| 5,855,288 | A | | 1/1999 | Dallas, Jr. |
| 6,102,225 | A | | 8/2000 | Lynn |
| 6,164,484 | A | | 12/2000 | Fiore et al. |
| 6,220,471 | B1 | | 4/2001 | Lowry |
| 6,296,136 | B1 | | 10/2001 | Huet |
| 6,868,980 | B2 | | 3/2005 | Schultz et al. |
| 7,311,218 | B2 | | 12/2007 | Varadarajan |
| 7,337,916 | B2 | | 3/2008 | Clougherty |
| 7,591,394 | B1 | | 9/2009 | Shingle |
| 7,703,625 | B2 | | 4/2010 | Westphal |
| 7,712,626 | B2 | | 5/2010 | Vovan |
| 7,909,204 | B2 | | 3/2011 | Antal, Sr. |
| 2008/0047965 | A1 | | 2/2008 | Gu et al. |

* cited by examiner

SEALING OVERCAP FOR A CONTAINER

CROSS-REFERENCE TO RELATED APPLICATIONS

This Application is a U.S. National Phase Filing Under 35 U.S.C. §371 based upon and claiming priority Under 35 U.S.C. §119(a)-(e) to International Application No. PCT/US2012/059180, filed Oct. 8, 2012, the entire disclosure of which is incorporated by reference herein. This international application claims the benefit of the filing date for U.S. Provisional Application No. 61/546,377, filed Oct. 12, 2011.

FIELD OF THE INVENTION

The present invention relates to an overcap for sealing the top end of a container.

BACKGROUND OF THE INVENTION

Containers having removable overcaps have been used for a variety of products, including powdered materials, such as food products, cleaning products, etc. Easy-open containers are often constructed of a composite cylindrical body portion having end closures for closing and sealing the container. In some examples, the top end closure comprises an end ring, fixed to the container body, and an inside circular peripheral rim in the form of an inwardly directed flange, which may include a curved edge. The inner rim defines a central opening of desired size for access to the interior of the container. A removable membrane patch may be used to cover the central opening and may be attached to the inwardly extending flange. To open the container, the membrane patch is detached from the container, providing access to the product in the container through the exposed opening.

Removable overcaps are often formed to fit over the container top end portion and top end closure. The overcap serves many functions including, but not limited to, protecting the top of the container from damage before and after removal of the membrane, keeping unwanted items from getting into the container, keeping the product within the container from spilling out, helping to improve stacking of the container, and increasing the life of the product after opening.

In addition, when moisture or oxygen sensitive products are packaged in the container, there is a need for sealing the container, after removal of the membrane, to deter undesirable exposure of the contents of the container to the ambient environment.

The resealing overcap shown in U.S. Pat. No. 6,220,471 to Lowry includes a generally circular body that fits over the top end of a cylindrical container. The overcap also includes a resealing flange in the form of a ring projecting downwardly from the body of the overcap. The resealing ring may be moved into sealing engagement with the inner rim formed on the top end of the container.

The resealing overcap shown in U.S. Pat. No. 7,909,204 to Antal, Sr. includes a body portion fitting over the periphery of the top end closure of a container and further includes a sealing portion for releasably engaging an inner rim of an access opening on the container. The sealing portion includes a downwardly depending flange in the form of a plug having a peripheral dimension approximately equal to the dimension of the inner rim and an engagement bead for engaging the inner rim with a friction fit. In addition, one or more vents are formed on the engagement bead. The vents are active during engagement of the bead with the inner rim, prior to forming the friction fit with the inner rim.

SUMMARY OF THE INVENTION

The present disclosure in one aspect relates to an overcap suitable for use in sealing a container of the type having an outer rim, an inside wall surface, and an inner rim spaced inwardly from the inside wall surface, with the inner rim forming a container opening. The overcap includes a body portion releasably fitting over the outer rim of the container and covering the opening into the container. A peripheral skirt extends from the body portion and is dimensioned to surround the outer rim of the container. A flexing portion is formed within the body portion. The flexing portion includes a first sealing position and a second sealing position with respect to the container and includes a downwardly depending wall member having an outer sealing surface and a movable sealing plug. The wall member is positioned adjacent the inside wall surface of the container in the first sealing position. The sealing surface is outwardly formed on the wall member and the related dimensions provide for engagement of the sealing surface with the inside wall surface in the first sealing position. The sealing plug is moveable from the first sealing position to the second sealing position. The sealing plug includes a peripheral surface dimensioned for frictional sealing engagement with the inner rim. The sealing plug releasably closes the opening in the second sealing position. The sealing plug is separated from the inner container rim in the first sealing position. The sealing surface engages the inside wall surface on the container in the first sealing position and movement of the sealing plug to the second sealing position causes resilient inward movement of the wall member, separating the sealing surface from the inside wall surface.

In a further aspect of the overcap, the flexing portion may comprise a series of interconnected walls joined by flex joints. In one aspect of the flexing portion, the sealing plug may be formed by a central planar member, an outwardly angled wall formed on the periphery of the central member, and an upwardly directed connecting ring. The connecting ring of the sealing plug may further form the frictional engagement surface with the inner rim in the second sealing position. In a further aspect of the flexing portion, the wall member and the sealing plug may be connected by an angled connecting wall.

In another aspect of the overcap, the sealing surface may comprises a specific sealing means projected from the wall member. In one aspect of the sealing means, a continuous engagement bead is formed on an outside surface of the wall member. In another aspect of the sealing means, a plurality of flexible rings may be formed on an outside surface of the wall member. In a still further aspect of the sealing means, a knurled portion may be formed as a continuous band on an outside surface of the wall member.

In a further aspect of the overcap, the sealing plug may be provided with plug sealing means positioned for engagement with the inner rim upon movement of the sealing plug into the second sealing position. In one aspect of the plug sealing means, a continuous engagement bead may be formed on an outside surface of the wall member. In another aspect of the plug sealing means, a plurality of flexible rings may be formed on an outside surface of the sealing plug. In a still further aspect of the sealing means, a knurled portion may be formed as a continuous band on an outside surface of the sealing plug.

In a still further aspect of the overcap, a plurality of vents may be foamed adjacent an engagement bead on a peripheral surface of the sealing plug. The vent being positioned to be activated during engagement of the sealing plug with the inner rim, prior to the frictional engagement with the inner rim during movement of the sealing plug into the second sealing position.

In a further aspect of the overcap, an engagement ridge is positioned on an inside surface of the peripheral skirt for engaging the outer rim of the container and for resiliently retaining the overcap on the container. In a still further aspect of the overcap, the body portion, the peripheral skirt, and the flexing portion are integrally formed from an injection molded plastic.

Other features and combinations of the elements specifically identified are contemplated as part of the present disclosure.

BRIEF DESCRIPTION OF THE DRAWINGS

For purposes of illustrating the invention, there is shown in the accompanying drawings a number of forms, which are presently preferred; it being understood, however, that the invention is not limited to the precise arrangements shown and instrumentalities shown.

DETAILED DESCRIPTION OF THE DRAWINGS

Figure 1:
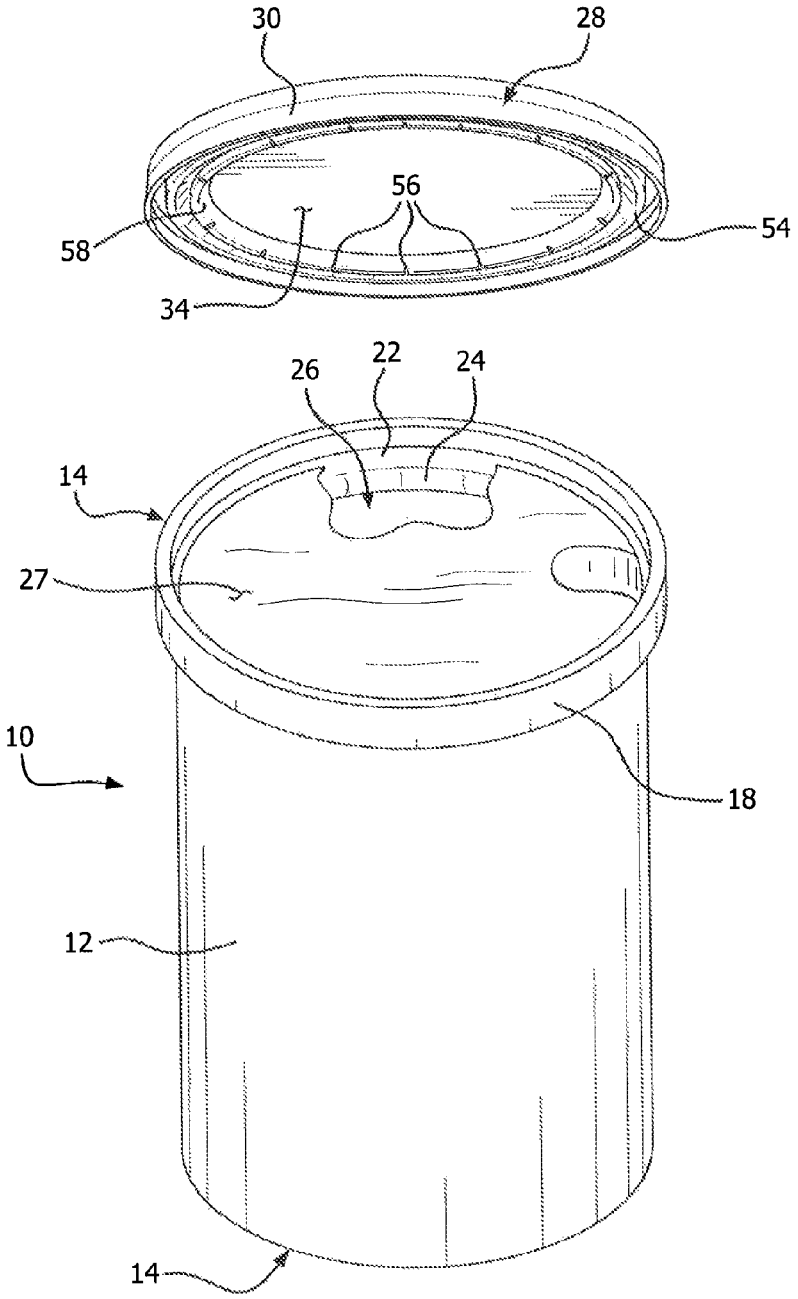
FIG. 1 is a perspective view of a container and overcap combination, with the overcap shown in an exploded position.

Referring now to the drawings, where like numerals identify like elements, there is shown in FIG. 1 a container, generally indicated by the numeral 10. The container 10 is adapted to be filled with a product (not shown), such as powdered or granulated food products, cleaning products, etc. The container 10 may be of any desired configuration and may be constructed of any desired material, including composites, plastic, metal, etc. It is preferred that the container have a generally cylindrical shape, although other shapes and profiles are contemplated. A removable overcap 28 is shown adjacent the container 10.

As illustrated, the container 10 comprises a generally cylindrical container body 12 defining top end 14 and an opposite bottom end 16. The container 10 includes top end closure 18 attached to the top end portion 14. A bottom closure (not shown) may also be included on the bottom end portion 16 of the container 10. The top end closure 18 is used to at least partially close and seal the top end 14 of the container 10 and the product retained therein (not shown). The closure 18 may be formed as part of the container body or attached to the container body 12 in any known manner. A bottom end closure may also be integrally formed with the container body 12 or attached to the bottom end portion 16.

Figure 2:
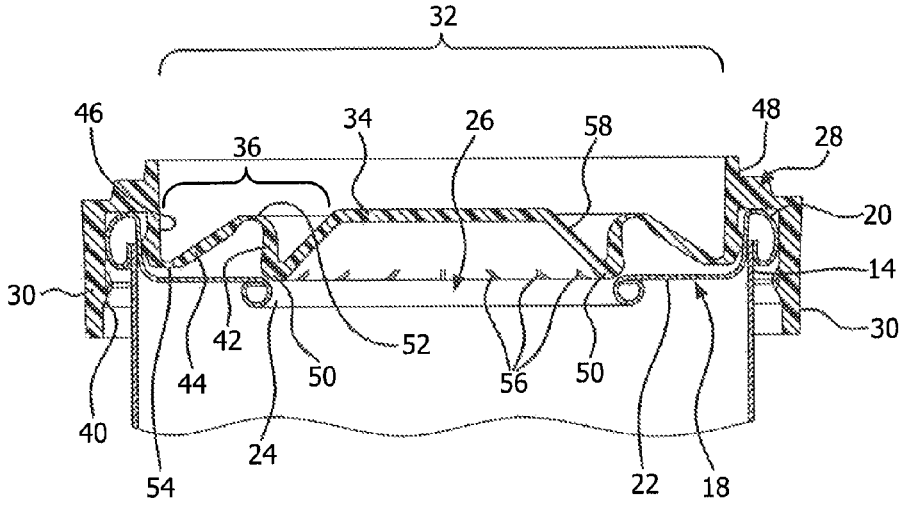
FIG. 2 is a cross-sectional view of the top portion of the container of FIG. 1 with an overcap embodiment in a form contemplated by the present disclosure shown in a first sealing position.
Figure 3:
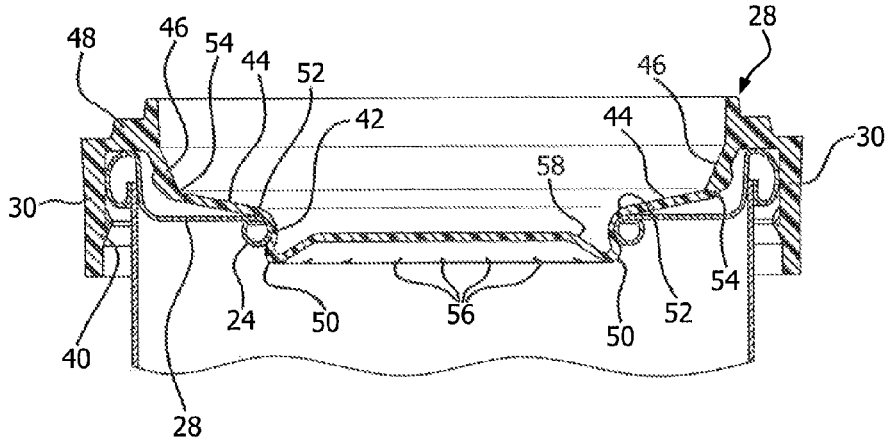
FIG. 3 is a cross-sectional view of the top portion of the container and the overcap embodiment of FIG. 2 engaged in a second sealing position.
Figure 4:
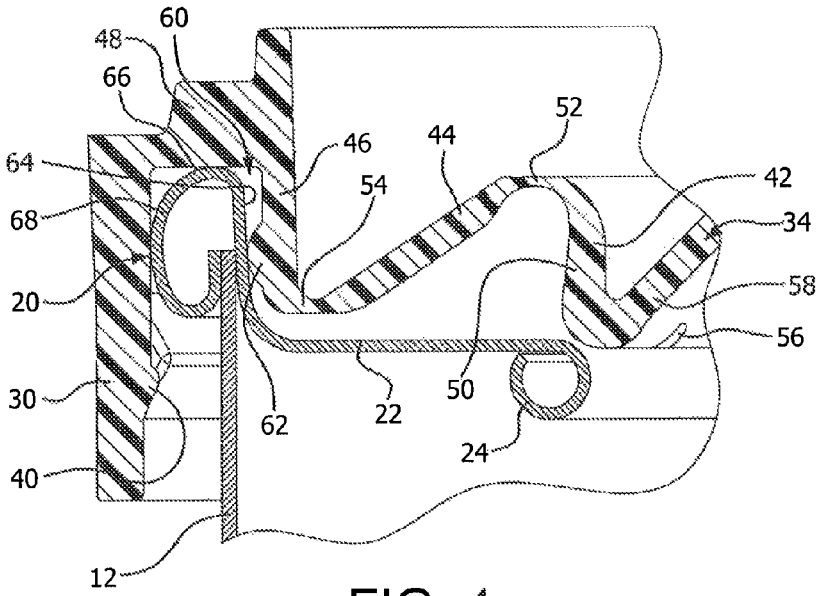
FIG. 4 is an enlarged, partial cross-section of the container and overcap in the first sealing position of FIG. 2.

As shown in cross-section in FIGS. 2-4, the top end closure 18 comprises an end ring 20 secured to the top end 14 of the container body 12 and defining an outer rim on the top end 14 of the container body 12. The end ring 20 includes a circular flange 22 extending inwardly from an inside wall portion of the outer rim of the ring 20. As illustrated, the flange 22 defines an inner rim 24 positioned radially inward from the inside wall and the outer rim. The inner rim is defined by a downwardly and inwardly curved or curled lip. However, the curl of the inner rim 24 is not required. A partial or upward curvature may also be defined. The edge of the inner rim 24 may be formed upon removal of a central portion of the flange, which may defined by a score line within the flange material, or may otherwise be defined, such as by a fold or bend in the flange material.

The opening 26 defined by the rim 24 is sized to allow access to the interior of the container 10. A sealing membrane patch (see 27, FIG. 1) may be provided to cover the opening 26 during shipment or storage of the filled container. The patch 27 is preferably secured to the flange 22 in a manner sufficient to resist the internal forces created within the container 10, while being removable to allow access to the contents of the container 10 through the central opening 26. The bond or attachment between the patch 27 and the flange 22 may be formed by any suitable means, including heat sealing, adhesive, polypropylene heat seal layer, etc. Alternatively, the container opening may be sealed by a removable portion (not shown) attached to or formed as part of the flange.

As shown in FIG. 2, the overcap 28 is provided over the top end 14 of the container 10 and releasably engages the closure 18. The overcap 28 includes a central body portion 32 and a skirt or flange 30 that extends downwardly from the periphery of the body 32. The skirt 30 surrounds the end ring 20 and preferably a snap or friction fit is formed between the outer surface of the end ring 20 and inner surface of the peripheral flange 30. A snap ridge 40 is provided on the inner surface of the skirt 30 and is dimensionally positioned to fit underneath the outward projection (68, see FIG. 4) of the end ring 20. The overcap 28 is preferably made of a flexible plastic material, allowing the outer skirt 30 to move around the outer rim of the end ring 20.

The body portion 32 of the overcap 28 includes a generally planar central portion 34 connected to the peripheral skirt 30 by a flexing portion 36. The flexing portion 36 permits the central portion 34 to move vertically relative to the outer skirt 30. The flexing portion 36 includes interconnected rings 42, 44 and a wall portion 46. As shown, in the normal rest position of the overcap 28, the wall portion 46 is generally parallel to and includes an outer surface that is spaced from the inside wall surface of the end ring 20. The wall 46 and skirt 30 are connected by a chime cover 48. The chime cover 48 forms the outer edge of the body portion 32. As discussed in more detail below, the wall portion 46 is dimensioned to form an initial seal between the overcap 28 and the end ring 20, when the overcap 28 is engaged on the top end 14 of the container body 10 in a first sealing position.

The central portion 34 of the overcap body 32 defines a sealing plug 38 for engagement with the inner rim 24 defined by the flange 22. An engagement bead or ridge 50 is formed at the joint between one connecting ring 42 and an angled wall portion 58 of the central overcap portion 34. The engagement bead 50 projects radially outward of the central portion 34 and preferably includes a peripheral dimension that extends radially outward from the central portion 34 by a sufficient distance so as to engage underneath the inner rim 24. This bead extension assists in retaining the plug 38 within the opening 26, with a friction fit formed between the plug 38 and the inner rim 24, as shown in FIG. 3, in a second sealing position for the overcap.

In FIG. 2, the overcap 28 is shown engaged on the end ring 20 and in its normal resting state. The illustration of FIG. 2 shows the first sealing position. In FIG. 3, the central portion 34 of the overcap 28 is pushed inward towards the opening 26, such that the sealing plug 38 is engaged with the inner rim 24 of the flange 22. The engagement bead 50 on the plug 38 is moved past the inner rim 24 of the opening 26 and provides an additional frictional engagement on an underside edge of the rim 24. The illustration in FIG. 3 shows a second sealing position.

The structures of the sealing plug 38 (including the angles wall 58 and the flex joint 42, as discussed below) form the downwardly depending flange on the overcap body 32. Further, the engagement bead 50 as shown include a series of vents 56. As the sealing plug 38 is moved toward the opening 26, there is an increase in pressure within the reservoir of the container 10. The vents 56 are provided on the underside of the bead 50. The vents 56 engage the flange 22 upon initial contact of the bead 44 with the inner rim 24. During the downward movement, the pressure increases within the container 10 and air attempts to move outwardly through the central opening 26, around the contacting surfaces. The pressure increase normally tends to resist the engagement of a plug with the sealing rim, and may muffle the sound of the friction fit (snap fit) between the two parts.

The vents 56 on the bead 50 permit air to move around the bead 50 during the engagement with the rim 24. This venting results in a reduction in the pressure in the container. Further, during final passage of the bead 50 around the rim 24, a more audible "snap" sound is provided. Hence, the user is provided with an audible indication of a sealing engagement and the force required to create the sealing engagement is reduced. Preferably, the vents 56 do not extend around the bead 50, past the transition between its bottom surface and upper surface. The vents 56 preferably do not engage the inner rim 24 when the relatively upper or top surface of the bead 50 is sealed below the ring 24. The number of vents may vary as desired, depending on the level of engagement between the sealing plug and opening into the container.

The movement of the sealing plug 38 from the position shown in FIG. 2 to the position in FIG. 3 is created by a downward force being applied to the upper surface of the central portion 34. The flexing portion 36 is formed by the connecting rings 42, 44 and wall 46. The rings are angled relative to one another. Flexible joints 52, 54 are located between the rings 42, 44 and the wall 46 and may have a reduced wall thickness, relative to the adjacent materials, to encourage flexing at the joints. As shown in FIG. 2, the rings 42, 44 are angled with respect to one another in the first sealing position. The rings 42, 44 are also angled with respect to the wall portion 46 on one side and the bead 50 at the periphery of the sealing plug 38. The sealing plug 38 as shown includes an angled peripheral wall 58, extending downwardly from the central portion 34.

In the first sealing position shown in FIGS. 2 and 4, an outer sealing surface 60 is formed by the outer surface of wall 46 and the inside wall surface 64 of the end ring 20. The sealing plug 38 in this first sealing position is located above the flange 22 and, thus, is not sealed within the opening 26. The outer sealing surface 60 may include sealing means in a number of forms. In FIG. 4, the sealing means is formed by a sealing bead 62 positioned on the outer surface of the wall 46. The dimensions are defined such that the sealing bead 62 contacts and engages the inside wall surface 64 of the end ring 20. The sealing bead 62 is preferably continuous and flexible, so as to seal completely around the inside perimeter of the inside wall surface 64. The flexing portion 36 of the overcap 28 may be formed to provide an engagement force, directing the bead 62 into contact with the inside wall surface 64. In addition, the bead 62 may be dimensionally or structurally formed to encourage the sealing contact with the surface 64. The seal created by the bead 62 is in addition to any sealing action created by the inside surface of the chime cover 48 with the chime portion 66 of the end ring 20 or the engagement of the inside surface of the outer skirt 30 of the overcap 28 with the outside edge 68 of the ring 20. Alternatively, vents may be provided between the underside of the chime and the outer rim of the container.

Figure 5:
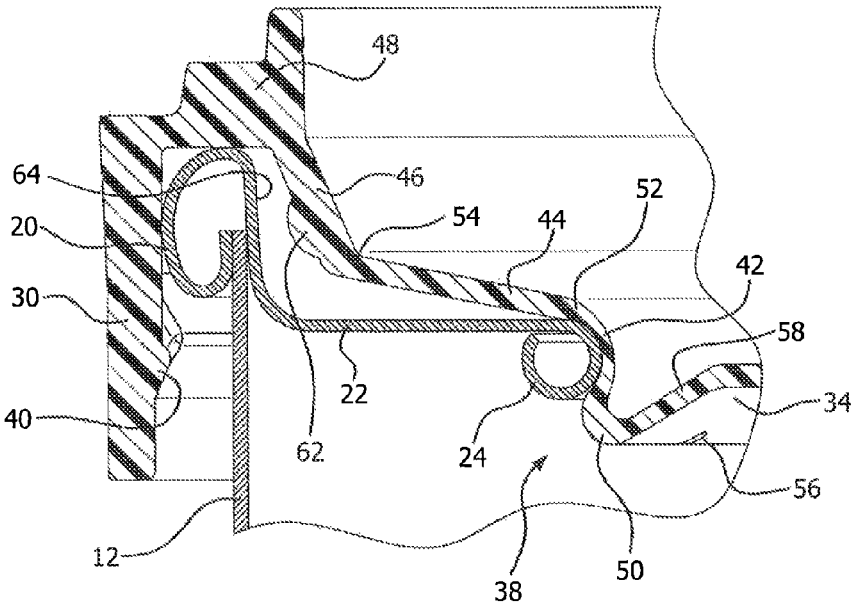
FIG. 5 is an enlarged, partial cross-section of the container and overcap in the second sealing position of FIG. 3.

In the second sealing position shown in FIGS. 3 and 5, the sealing plug 38 is pushed into engagement with the inner rim 24 and fills the opening 26. During movement of the plug 38 towards the flange 22 and opening defined by the inner rim 24, the elements of the flexing portion 36 move relative to one another to permit the end of the plug 38 and the bead 50 to engage with the inner rim 24. The relative movement of the connecting rings 42, 44 and radial wall 46, about the flex joints 52, 54 create the flexing motion, acting to elongate the surface of the body portion 32 and permit the plug 38 to move from the position shown in FIG. 4 to the second sealing position shown in FIG. 5. During this flexing motion, the outside wall 46 is moved inwardly, with the sealing surface of bead 62 moving away from the inside wall surface 64 of the end ring 20. Hence, as illustrated, in the second sealing position, the outer seal created by the sealing means is no longer active.

During movement of the sealing plug 38 into engagement with the inner rim 24 of the flange 22, air from the container body 12 is moved around the forming seal through the vents 56. The release of the sealing surface from the inside wall surface 60 permits the moving air to be directed into the area bounded by the flexing portion 36, the inner surface 64 of the rim and the upper surface of the flange 22. Preferably, the air expelled by the sealing plug 38 moves over the chime 66, past the projecting edge 68, past snap ridge 40 on the flange 30, and into the ambient atmosphere. Again, vents may be formed to direct this air movement. The excess air and pressure is directed away from container interior and may be helpful in maintaining the shelf life of certain products retained in the container. Further, the positioning of the seal plug into engagement with the inner rim, inside the access opening, serves to reduce the head space within the container, further enhancing the shelf-life of the retained product.

Figure 6:
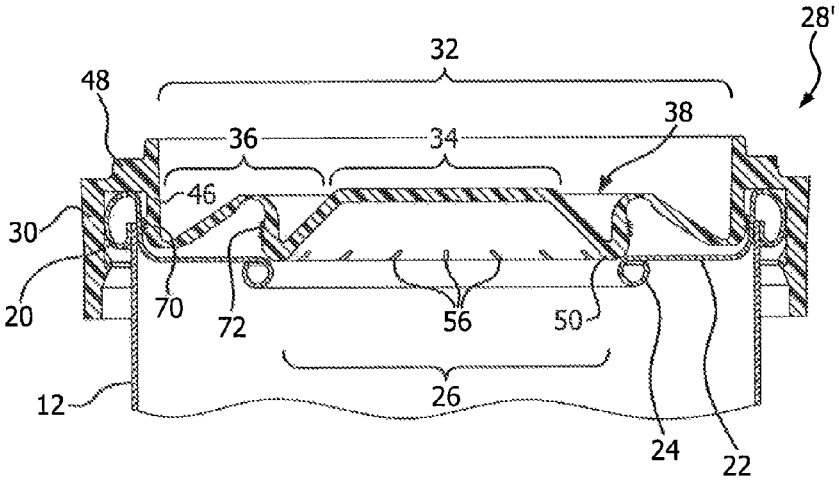
FIG. 6 is a cross-sectional view of the top portion of a container with a further embodiment of the overcap engaged in a first sealing position.
Figure 7:
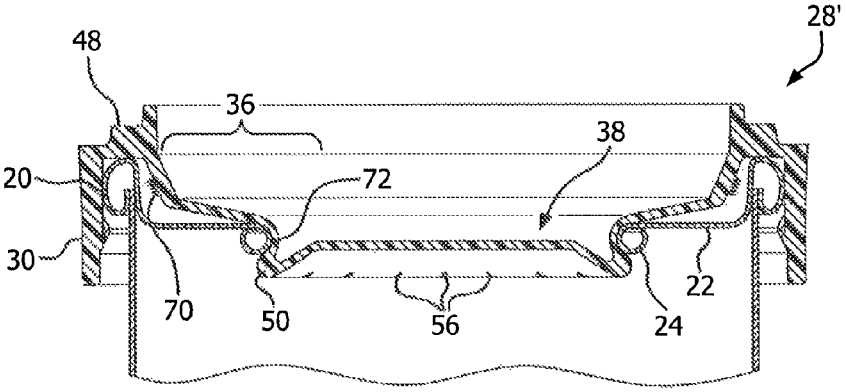
FIG. 7 is a cross-sectional view of the top portion of a container with the further embodiment of the overcap of FIG. 6 engaged in a second sealing position.

In FIGS. 6-9, there are shown variations of the structures discussed above with respect to FIGS. 2-5. In FIG. 6, the overcap 28' is shown in a first sealing position, similar to FIGS. 2 and 4. The overcap 28' includes a body portion 32 comprised of a flexing portion 36 and the central portion 34, which forms the sealing plug 38. The sealing plug 38 includes a downwardly depending engagement bead 50 having (optional) vents 56 formed on the underside surface. The bead 50 is formed to engage the rim 24 of the central opening 26. The rim engagement by the plug 38 and the bead 50 is shown in FIG. 7. Movement of the sealing plug 38 is assisted by the connected rings and flex joints that make up the flexing portion 36.

Figure 8:
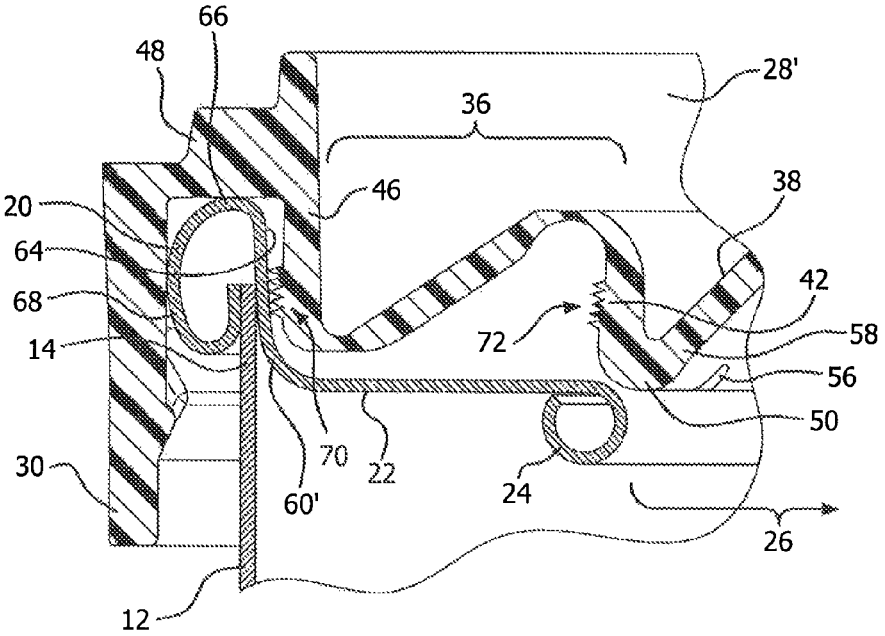
FIG. 8 is an enlarged, partial cross-section of the container and the further embodiment of the overcap in the first sealing position of FIG. 6.
Figure 9:
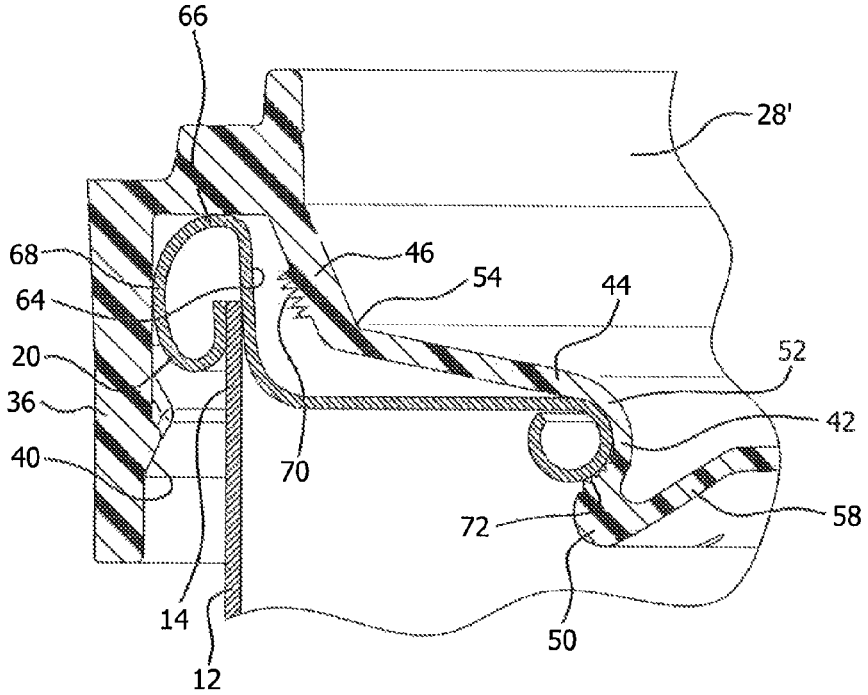
FIG. 9 is an enlarged, partial cross-section of the container and the further embodiment of the overcap in the second sealing position of FIG. 7.

In FIGS. 8 and 9, the structure of the overcap 28' is shown in more detail as is the formation of the first and second seals with the end ring 20. In FIG. 8, the first sealing position is shown with the sealing plug 38 positioned above the opening 26 and spaced from the flange 22. An outer seal 60' is formed between the radial wall 46 and the inner surface 64 of the end ring 20. An engagement member 70 is provided on the outside surface of the wall 46. The sealing means of the engagement member 70 is in the form of a series of flexible ribs. In FIG. 8, the ribs 70 are shown engaged with the inner ring surface 64.

As also shown in FIG. 8, a second series of engagement ribs 72 is formed on the outer surface of connecting ring 42. In the first sealing position, this second sealing structure is not engaged with the flange 22 or inner rim 24. The ribs 72 are located relatively above the engagement bead 50 at the projected edge of the sealing plug 38. In FIG. 9, the overcap 28' is shown in the second sealing position, with the sealing plug 38 inserted into the opening 26. The engagement bead 50 is positioned below the inner rim 24 to assist in retaining the plug 38 within the opening 26. The second series of ribs 72 are aligned with the inside edge of the rim 24. The flexing of the ribs 72 serves to engage the rim 24 and provide further assistance to the seal of the plug 38 in the opening 26.

In this second sealing position for the overcap 28', the ribs 70 of the outer seal 60 are spaced from the inside surface 64 of the end ring 20. The flexing of the connected rings and flex joints allow for movement of the sealing plug 38 from the position shown in FIG. 8 to the second sealing position of FIG. 9. This flexing, in turn, causes the movement of wall member 46 away from the inner surface 64 of the end ring 20. The spacing of the ribs 70 from the inside wall surface 64 of the end ring 20 opens a passage for moving air displaced by the sealing plug 38 movement into the second sealing position. Removal of the plug 38 from the opening 26 resiliently returns the overcap to the first sealing position shown in FIG. 8.

The ribs 70 and 72 are preferably flexible and add to the effectiveness of the seal with the inside wall 46 of the end ring 20 and the inner rim 24 of the flange 22. The end ring 20 and flange rim 24 are preferably dimensionally rounded and have smooth surfaces. However, formation and assembly may cause tolerance variations in the surfaces. In addition, shipment and use of the container may cause bending or displacement of the elements and results in misalignment of the surfaces.

A ribbed or similar sealing surface is intended to create a system for encouraging the seal with the surfaces of the container closure 18. The flexible nature of the ribs 70, 72, due to their relatively small dimension and use of a flexible material for the overcap, creates a resilient surface that may conform to imperfections in the surfaces and part positions. The number of ribs may vary as desired, with a single ring or multiple rings being possible. The ribs are preferably thin and relatively flexible, so as to permit deflection relatively easily, and are shown as being closely spaced and parallel to one another. Upon engagement of the ribbed surfaces sealing means with the inside wall of the end ring and/or the inner rim surface, the ribs preferably deflect and collapse to seal along the engaged surface. The amount of deflection will vary depending on the form of the ribs, the relative spacing of the parts, the resiliency of the overcap or rib material (and potentially the engagement surfaces), the spacing of the ribs, etc.

Figure 10:
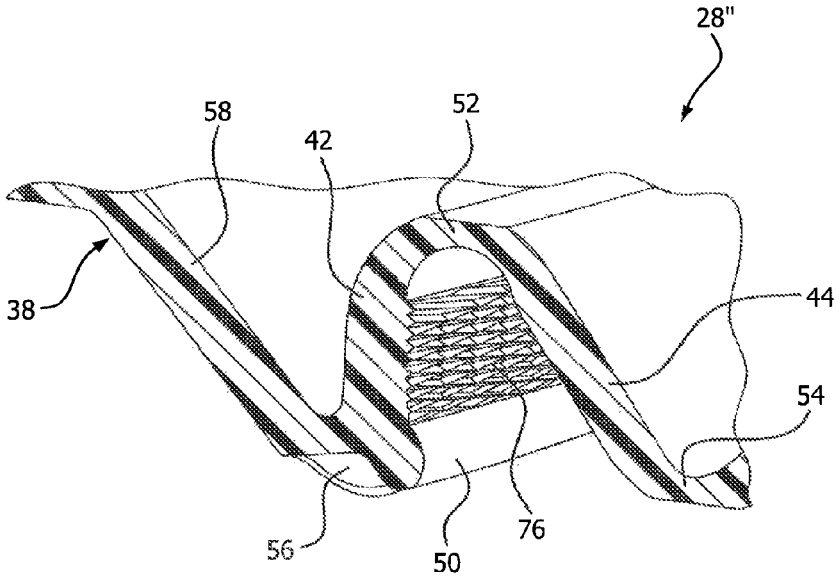
FIG. 10 is an enlarged, sectioned and partial view of a portion of the further embodiment of the overcap.

In FIG. 10 there is shown an alternate structure for a sealing member. In the partial view of this figure, the sealing member 76 is formed by a knurled pattern having a series of closely positioned projections or bumps forming a continuous band. The sealing member 76 is shown on the outer surface of the connecting member 42, above the engagement bead 50 on the sealing plug 38. As shown, the series of projections 76 define a flexing surface that will conform to the inner rim (26) of the flange (22) upon engagement of the sealing plug 38 within the opening (26) in the end ring (20). The projections are contemplated to have an offset arrangement, such that a continuous gap line is not readily defined between the top edge and bottom edge of the band. In addition, the projections may be contoured to increase flexibility and to otherwise enhance the non-distinct pathway. Other projection positions and formations are possible in creating a knurled band. The knurled sealing pattern shown in FIG. 10 may also be provided for the first seal member on the outside surface of the radial wall 46.

Other forms of sealing surfaces and members are contemplated for the sealing surfaces formed on the first and second sealing locations. For example, a continuous bead may be provided for the plug sealing means (similar to that shown in FIGS. 2-5 with respect to the wall sealing means). In addition, one of the various sealing surfaces may be provided on one or both locations as discussed above. Additional or alternative sealing locations are also possible. The intent of the sealing surface is to enhance the sealing arrangement of the primary seal fowled by the engagement of the overcap with the end ring portion of the open end of the container and/or the engagement of the sealing plug within the access opening defined by the rim of the flange.

Other sealing locations are possible, including the provision of a sealing means at the base of the inside wall in the overcap structures shown, at a position below the flex joint. A seal surface, such as a raised bead, ribs, a knurled band or otherwise, may be formed to engage the upper surface of the flange 22, between the inner surface 46 of the end ring and the inner rim 24. Pushing the sealing plug 38, or similar structure, into the opening 26 will cause relative movement of the flexing members and separate this seal surface away from the flange.

The overcap of the present embodiments is preferably formed from a relatively flexible thermoplastic material, including olefins, such as polyethylene and polypropylene, polyvinyl chloride or similar materials. The properties for such materials may vary depending on the structure, dimensions and application for the overcap. The material is preferably on the lower end of the flex modulus. It is contemplated that if the material is relatively rigid, the sealing arrangement may be compromised, in addition to making more difficult the snap fit of the overcap onto the container end and the insertion of the sealing plug into the opening.

The overcap is preferably injection molded using known techniques. A two-shot molding process may also be used, if a variation of the material properties within the overcap structures is desired. For example, the sealing surfaces, such as the raised bead, ribs, knurled band, etc, may be formed by an over-molding operation, using a more rigid material for the body of the overcap and a softer, more flexible material for the sealing surface(s). The sealing surfaces may also be formed as the initial shot of material in the two-shot process.

In the drawings and specification, there has been set forth a preferred embodiment of this invention and, although specific terms are employed, these terms are used in a generic and descriptive sense only and not for purposes of limitation. The scope of the invention is set forth in the following claims.

What is claimed is:

1. An overcap suitable for use in sealing a container having an outer rim, an inside wall surface, and an inner rim spaced inwardly from the inside wall surface, the inner rim forming a container opening, the overcap comprising:

a body portion for releasably fitting over the outer rim of the container and for covering the opening into the container;

a peripheral skirt extending from the body portion and dimensioned to surround the outer rim of the container; and a flexing portion formed within the body portion, the flexing portion having a first sealing position and a second sealing position with respect to the container, the flexing portion comprising a downwardly depending wall member, the wall member positioned adjacent the inside wall surface of the container in the first sealing position, a sealing surface outwardly formed on the wall member, the wall member and sealing surface dimensioned for engagement of the sealing surface with the inside wall surface in the first sealing position, and a sealing plug moveable from the first sealing position to the second sealing position, the sealing plug having a peripheral surface dimension for sealing engagement of the inner rim with a friction engagement for releasable closing of the opening in the second sealing position, the sealing plug separated from the inner rim in the first sealing position, wherein the sealing surface engages the inside wall surface in the first sealing position and wherein movement of the sealing plug to the second sealing position of the flexing portion causes resilient inward movement of the wall member, separating the sealing surface from the inside wall surface.

2. An overcap as in claim 1, wherein the flexing portion comprises a series of interconnected walls joined by flex joints.

3. An overcap as in claim 1, wherein the sealing plug is formed by a central planar member, an outwardly angled wall formed on the periphery of the central member, and an upwardly directed connecting ring, wherein the connecting ring forms the frictional engagement surface with the inner rim in the second sealing position.

4. An overcap as in claim 1, wherein the wall member and the sealing plug are connected by an angled connecting wall.

5. An overcap as in claim 1, wherein the sealing surface comprises sealing means projected from the wall member.

6. An overcap as in claim 5, wherein the sealing means comprises a continuous engagement bead formed on an outside surface of the wall member.

7. An overcap as in claim 5, wherein the sealing means comprises a plurality of flexible rings formed on an outside surface of the wall member.

8. An overcap as in claim 5, wherein the sealing means comprises a knurled portion forming a continuous band on an outside surface of the wall member.

9. An overcap as in claim 1, further comprising plug sealing means formed on the sealing plug, the plug sealing means positioned for engagement with the inner rim upon movement of the sealing plug into the second sealing position.

10. An overcap as in claim 9, wherein the plug sealing means comprises a continuous engagement bead formed on an outside surface of the wall member.

11. An overcap as in claim 9, wherein the plug sealing means comprises a plurality of flexible rings formed on an outside surface of the sealing plug.

12. An overcap as in claim 9, wherein the plug sealing means comprises a knurled band on an outside surface of the sealing plug.

13. An overcap as in claim 1, further comprising a plurality of vents formed adjacent an engagement bead on a peripheral surface of the sealing plug, the vents being active during engagement of the sealing plug with the inner rim, prior to the frictional engagement with the inner rim during movement of the sealing plug to the second sealing position.

14. An overcap as in claim 1, further comprising an engagement ridge positioned on an inside surface of the peripheral skirt for engaging the outer rim of the container and for resiliently retaining the overcap on the container.

15. An overcap as in claim 1, wherein the body portion, the peripheral skirt, and the flexing portion are integrally formed from an injection molded plastic.

16. An overcap for use in sealing a container having a top end portion forming an outer rim and an inwardly defined rim, inwardly defined rim forming an opening into the interior of the container, the overcap comprising:

a body portion for releasably fitting over the outer rim of the container and for covering the opening into the container;

a peripheral flange extending from the body portion and dimensioned to surround the outer rim of the top end of the container;

a sealing plug having a peripheral dimension approximately equal to the dimension of the opening formed by the inwardly defined rim;

an engagement bead on the sealing plug dimensioned for engagement of the inwardly defined rim with a friction fit in a plug sealing position; and a resilient sealing surface formed on the outside surface of the sealing plug adjacent to the engagement bead, the sealing surface selected from the group comprising a plurality of flexible ribs and a flexible knurled band, wherein resilient movement of the sealing plug to the plug sealing position causes the friction fit engagement of the bead with the inwardly defined rim and a resilient sealing engagement of the sealing surface with the inwardly defined rim.

17. An overcap as in claim 16, further comprising:

a flexing portion formed within the body portion, the flexing portion allowing for resilient movement of the sealing plug between a first position and the plug sealing position.

18. An overcap as in claim 17, further comprising:

a wall member within the flexible portion positioned adjacent an inside surface of the outer rim of the top end of the container.

19. An overcap for use in sealing a container having a top end portion forming an outer rim and an inwardly defined rim, the inwardly defined rim forming an opening into the interior of the container, the overcap, comprising:

a body portion for releasably fitting over the outer rim of the container and for covering, the opening into the container;

a peripheral flange extending outwardly from the body portion and dimensioned to surround the outer rim of the top end, of the container;

a sealing plug, having a peripheral dimension approximately equal to the dimension of the opening, formed by the inwardly defined rim;

an engagement bead on the sealing plug dimensioned for engagement of the inwardly defined rim with a friction fit in plug sealing position; and a sealing surface formed on the outside surface of the, sealing plug, the sealing surface selected from the group comprising a plurality of flexible ribs and a knurled band, a flexing portion formed within the body portion, the flexing portion allowing for resilient movement of the sealing plug between a first position and the plug sealing position;

a wall member within the flexible portion positioned adjacent an inside surface of the outer rim of the top end of the container; and sealing means formed on the wall member, the sealing means extending outwardly from the wall member and dimensioned for engagement with the inside surface of the outer rim in a first sealing position of the overcap, wherein resilient movement of the sealing plug to the plug sealing position causes sealing engagement of the sealing surface with the inwardly defined rim, wherein the sealing plug is spaced from the inner rim in the first sealing position of the sealing means, and wherein the sealing means is spaced from the outer rim in the first sealing position of the overcap as a result of the flexing portion and the movement of the sealing plug to the plug sealing position.

20. An overcap as in claim 19, wherein the sealing means comprises a continuous engagement bead formed on the outside surface of the wall member.

21. An overcap as in claim 19, wherein the sealing means comprises a plurality of flexible rings formed on the outside surface of the wall member.

22. An overcap as in claim 21, wherein the flexible rings are closely spaced and positioned parallel to one another.

23. An overcap as in claim 19, wherein the sealing means comprises a knurled band formed on the outside surface of the wall member.

24. An overcap as in claim 23, wherein the knurled band comprises a plurality of spaced flexible projections.

25. In a container comprising a container body defined by a side wall, a top end portion and a bottom end portion opposite the top end portion, a top end closure is attached to the top end portion for closing and sealing the container with product therein, the top end closure including an end ring having a peripheral outer rim secured to said container body top end portion and an inner rim defining an access opening into the interior of the container, a resealing overcap comprising:

a body portion constructed for releasably engaging the peripheral outer rim of the end ring closure and closing the opening into the container;

a downwardly depending portion within the body portion resiliently moveable from a first position to a second sealing position; the depending portion having an engagement bead thereon, the engagement bead having a peripheral dimension approximately equal to the dimension of the inner rim for engagement of the inner rim with a friction fit in the second sealing position, the depending portion having an outer surface spaced from the engagement bead, the outer surface engaging the inner rim in the second sealing position; and a resilient sealing structure formed on the outer surface of the depending portion, the resilient sealing structure selected from the group comprising a continuous ring, a plurality of ribs and a knurled band, wherein resilient movement of the depending portion to the second sealing position causes the engagement bead to frictionally lock the depending portion with the inner rim and the resilient sealing structure to resiliently seal the depending portion with the inner rim.

26. An overcap as in claim 25, wherein the depending portion comprises a sealing plug.

27. An overcap as in claim 25, further comprising:

a plurality of vents formed adjacent the engagement bead on the opposing side of the engagement bead from the sealing structure, the vents being active during engagement of the sealing plug with the inner rim during movement of the depending, portion towards the second sealing position, prior to the frictional engagement of the engagement bead with the inner rim and prior to the sealing structure sealing the depending portion with the inner rim.

28. In a container comprising a container body defined by a side wall, a top end portion and a bottom, end portion opposite the top end portion, a top end closure is attached to the top end portion for closing and sealing the container with product therein, the top end closure including an end ring having a peripheral outer rim secured to said container body top end portion and an inner rim defining an access opening into the interior of the container, a resealing overcap comprising:

a body portion constructed for releasably engaging the peripheral outer rim of the end ring closure and closing the opening into the container;

a downwardly depending portion within the body portion resiliently moveable from a first position to a second sealing position; the depending portion having a peripheral dimension approximately equal to the dimension of the inner rim for engagement of the inner rim with a friction fit in the second sealing position, the depending portion having an outer surface for engagement with the inner rim; and a sealing structure formed on the outer surface of the depending portion, the sealing structure selected from the group comprising a continuous ring, a plurality of flexible ribs and a knurled band, wherein resilient movement of the depending portion to the second sealing position causes sealing engagement of the sealing structure with the inner rim; and a flexing portion within the body portion, the flexing portion providing for resilient movement of the depending portion during engagement with the inner rim, at least one portion formed as part of the flexing portion positioned adjacent a surface of the outer rim of the container, and sealing means formed on the at least one portion, the sealing means dimensioned for sealing engagement with the outer rim in a first sealing position, wherein the sealing means engages the inside surface of the outer rim in the first sealing position and movement of the depending portion to the second sealing position causing the flexing portion to create an inward movement of the sealing means away from the outer rim.

29. An overcap as in claim 28, wherein the sealing means comprises a plurality of flexible rings formed on the at least one portion of the flexing portion.

30. An overcap as in claim 28, wherein the sealing means comprises a knurled portion forming a continuous band on the at least one portion of the flexing portion.

* * * * *